United States Patent [19]

Terrell

[11] Patent Number: 4,971,146

[45] Date of Patent: Nov. 20, 1990

[54] DOWNHOLE CHEMICAL CUTTING TOOL

[76] Inventor: Jamie B. Terrell, 1916 Christopher Dr., Fort Worth, Tex. 76140

[21] Appl. No.: 275,265

[22] Filed: Nov. 23, 1988

[51] Int. Cl.[5] ..... E21B 23/04; E21B 29/02

[52] U.S. Cl. ..... 166/55; 166/63; 166/212; 166/217

[58] Field of Search ..... 166/55, 55.1, 55.2, 166/55.3, 55.7, 55.8, 297, 63, 212, 217

[56] References Cited

U.S. PATENT DOCUMENTS

| | | | |
|---|---|---|---|
| 2,918,125 | 12/1959 | Sweetman | 166/55 X |
| 2,965,031 | 12/1960 | Johns | 166/55 X |
| 3,076,507 | 2/1963 | Sweetman | 166/55.2 X |
| 4,125,161 | 11/1978 | Chammas | 166/55 X |
| 4,250,960 | 2/1981 | Chammas | 166/55 |
| 4,345,646 | 8/1982 | Terrell | 166/212 X |
| 4,415,029 | 11/1983 | Pratt et al. | 166/217 X |
| 4,619,318 | 10/1986 | Terrell et al. | 166/55 |
| 4,620,591 | 11/1986 | Terrell et al. | 166/55 X |

*Primary Examiner*—Stephen J. Novosad

*Attorney, Agent, or Firm*—Richards, Harris, Medlock & Andrews

[57] ABSTRACT

A downhole chemical cutting tool having an anchoring system employing interchangeable slip arrays of progressively larger outside diameters that can be used economically to adjust the range of the anchoring system. The range can be further adjusted by utilizing interchangeable slip expansion mandrels. This anchoring system both anchors and centralizes the chemical cutting tool. The cutting tool includes a slip shaft that provides fluid communication between the propellant section and chemical section, thence to the slip piston that receives the interchangeable slip arrays. The slip shaft and slip piston are threadably connected to a set coiled tension spring. Interchangeable slip expansion mandrels connected to the slip shaft below the slip arrays are constructed with ball bearings on the surface that receives the slip arrays expanding the slip segments into a gripping engagement an usually large angle as the slip piston is actuated by the application of fluid pressure during the cutting operation. The interchangeable slips are configured so that the gripping teeth will simultaneously engage the internal surface of the wellbore pipe being cut. During the cutting operation the application of fluid pressure activates the slip assembly and discharges the chemical cutting fluid from the chemical section into the fluid jet section of the tool at high temperature and velocity. After the release of fluid pressure the slip assembly reliably releases the tool due to the large angle of engagement of the slip segments.

23 Claims, 4 Drawing Sheets

DOWNHOLE CHEMICAL CUTTING TOOL

TECHNICAL FIELD

This invention relates to an anchoring mechanism that anchors and centralizes a tool in different sizes of pipe and more particularly, relates to such tools that chemically cut, perforate, slot, and completely cut as well as disintegrate pipe or other objects in a wellbore.

BACKGROUND OF THE INVENTION

Innovative and simplified oil well service tools that offer high reliability must be developed due to the extreme economy by which oil field services must now operate. Whenever pipe is to be cut, recovered, or freed, experience has shown that the cut produced by a chemical cutter offers the least trouble, smallest overall expense and the highest success in the recovery operation. This is because the cut is not flared, has no burrs or sharp projections, and the inside and outside diameters around the cut are not changed. Therefore, an overshot can be deployed downhole and be easily placed over the outside of the pipe string without incurring the additional cost of a milling operation in order to recover the pipe.

Chemical cutters can be used to great advantage in the application of chemicals to cut, sever or perforate downhole pipe. For example, in U.S. Pat. No. 2,918,125 to Sweetman halogen fluorides are employed in jet streams impinging on the pipe to sever or perforate the pipe. The attendant reaction is highly exothermic and the pipe is rapidly penetrated. Additionally, as disclosed in U.S. Pat. No. 4,619,318 to Terrell and Pratt, objects may be perforated or in some instances completely dissolved downhole by a chemical cutter, with no debris left in the well. The halogen fluoride used in the chemical cutter produces a chemical reaction that completely dissolves the pipe in the cut area. Since there are no expendable mechanical parts of the chemical cutter, no debris is left downhole.

During the course of the cutting operation, the cutting tool must be anchored at the desired location within the well. This is particularly the case where the cutting tool is run into the well on a wireline. One technique for anchoring the tool employs the use of fluid pressure from a suitable source to both activate the anchoring means and dispel cutting fluid from the tool against the surface to be severed or otherwise cut. For example, an anchoring means is disclosed in U.S. Pat. No. 3,076,507 to Sweetman wherein the chemical cutter anchoring means comprises "button slips" that are radially projected by the chemical cutter tool's pressurizing medium to anchor the tool to the wellbore casing. However, this anchoring means fails to positively centralize the tool and the "button slips" can occasionally penetrate through old pipe, thus sticking the tool downhole. In addition, should the tool be accidentally discharged above the ground, the "button slips" could be discharged at high velocities similar to bullets from a gun, which could result in the injury of operational personnel or equipment.

U.S. Pat. No. 4,125,161 to Chammas discloses another anchoring means for a chemical cutter in which gas from a propellant charge displaces a piston to cam one or more wedges outwardly against the tubing string or object to be severed. The gas from the propellant charge is also employed to force the cutting chemical into contact with a preignitor and thence outwardly through ports into contact with the pipe to be severed. The wedges of this invention afford inadequate anchoring and centralization occasionally when severing pipe downhole. The wedges of this anchoring system offer limited range and limited anchoring capabilities, permitting the tool to be occasionally shot up hole while a cut is being made.

A particularly effective chemical cutting tool is disclosed in U.S. Pat. No. 4,345,646 to Jamie B. Terrell. In this tool a chemical module assembly is located intermediate to a propellant assembly and a cutting head assembly. Gas pressure generated by the ignition of a propellant charge is employed to rapidly move a slip array against a slip expander, during which time the cutting action takes place. The slip array is then rapidly retracted by means of a biasing mechanism. The slip segments are disposed in the array in a manner to provide maximum utilization of surface area of the slip assembly for engaging the surrounding pipe. A tension spring, referred to in this patent as a "garter spring", is provided around the slip segments in order to bias the slip segments inwardly against the slip shaft. The garter spring is disposed within slotted recesses within the slip segments located between the teeth of the slip segments and the heads of the slip segments.

U.S. Pat. No. 4,415,029 to Terrell discloses a chemical cutting tool having another form of slip actuating means and slip array configuration. The well tool anchoring means of this patent comprises a slip array located on a slip shaft and interposed between suitable actuation means and slip expansion means. The slip segments are biased inwardly by means of cantilever springs secured to a structural member of the cutting tool and projecting into engagement with downward movement of the slip segments. Preferably the slip segments are arranged in the array in a diametrically asymmetrical relationship. Also disclosed in aforementioned U.S. Pat. No. 4,415,029 to Terrell is a large external spring biasing means to force the slip piston into the retracted position.

Another cutting tool is disclosed in U.S. Pat. No. 4,620,591 to Terrell and Pratt. In this patent, the inwardly slip biasing function is provided by a mechanism which includes expandable slip segments each having a raised ridge in each side of the segments. Each ridge is mounted through annular grooves which in cooperation with ball bearings serve to splay the slips outwardly in response to a downward force. This patent also discloses the use of an external spring which is threaded onto the slip shaft and a top slip subassembly in which the slip segments of the slip array are mounted.

SUMMARY OF THE INVENTION

In accordance with the present invention there is provided a new chemical cutting tool having improved anchoring means that can be economically adjusted to anchor and centralize the tool in different sizes of wellbore pipe by utilizing interchangeable slip arrays that fit a common anchoring means assembly. In particular, the anchoring means of this chemical cutter is constructed to receive different interchangeable slip arrays wherein each array is constructed with sets of serrated gripping teeth that are progressively and "set-wise" increased in their outside diameters. The outside diameters of each set of teeth of a particular slip array is constructed to optimally anchor and centralize the tool in a narrow range of inside diameters of pipe which are usually specified as a single outside pipe diameter. Therefore, a single common anchor assembly of this invention can be equipped to anchor and centralize the tool in various sizes or diameters of pipe, by utilizing individual interchangeable slip arrays each constructed for particular pipe size.

The chemical cutter tool of the present invention comprises an elongated slip shaft having a fluid passage extending longitudinally therethrough and equipped with at least one exhaust port providing fluid communication to the exterior of the slip shaft. In a preferred embodiment of the invention, a slip piston is slidably disposed on the slip shaft and threadably connected to the slip shaft by means of a coiled spring. One end of the coiled spring is threadedly connected to the slip shaft and the other end of the spring is threadedly connected to the slip piston with a thread form matching the inside surface of the spring. The interchangeable slip arrays are each comprised of a plurality of slip segments that are slidably disposed around the slip shaft and pivotally connected to the slip piston. The slip piston is of a configuration to define a chamber which opens to the exhaust port of the slip shaft. This chamber has an active surface interposed between the exhaust port and the slip piston such that the application of pressure in the slip shaft is transferred via the exhaust port to this active surface and forces the slip array in the direction of the expansion mandrel which splays the slip array segments outward in the anchoring and centralizing position. The threaded coil spring provides a biasing action to the slip piston in a direction away from the expansion mandrel to a retracted position as the fluid pressure in the piston chamber is released. Ball bearings are mounted on the upper surface of the slip array expansion mandrel. Interchangeable mandrels of different outside diameters that may be used to vary the opening ranges of the slip arrays. The ball bearings provide a surface adapted to receive the slip segments and expand the slip array in the deployed position. Additionally, the bearings eliminate the need to harden the tapered surface of the expansion mandrel.

In a further aspect of the invention, the improved chemical cutter anchoring means are constructed to engage the pipe in the deployed position at an angle of approximately 18 degrees or larger between the bottom cylindrical surfaces of the slip segments and the horizontal axis of the chemical cutter. This high angle of engagement during the anchoring operation prevents the slip segments from wedging between the pipe and the expansion mandrel preventing the chemical cutter tool from sticking downhole. The slip segments are biased inwardly by means of a tension spring with hooked ends. The hooked ends are joined together by a soft wire interconnecting loop which forms the tension spring into a closed loop tension spring. The closed loop tension spring, referred to herein as a garter spring, is placed in a specially formed groove in each interchangeable slip array to provide the required inward biasing for each array. Preferably, the top portion of the slip segments above the gripping teeth in each interchangeable array is constructed with a truncated oblate torus of identical mechanical dimensions hold the array in a common slip piston. The slip segments are fitted to the slip piston during assembly operations by placing the oblate torus into the partially open cylindrical cavity of the slip piston. Additionally, the groove above the teeth used to hold the common garter spring is cut with identical mechanical dimensions in all slip segments for all interchangeable slip arrays. Therefore, the same slip piston and the same garter spring can be used with all interchangeable slip arrays.

DESCRIPTION OF PREFERRED EMBODIMENTS

Figure 1:
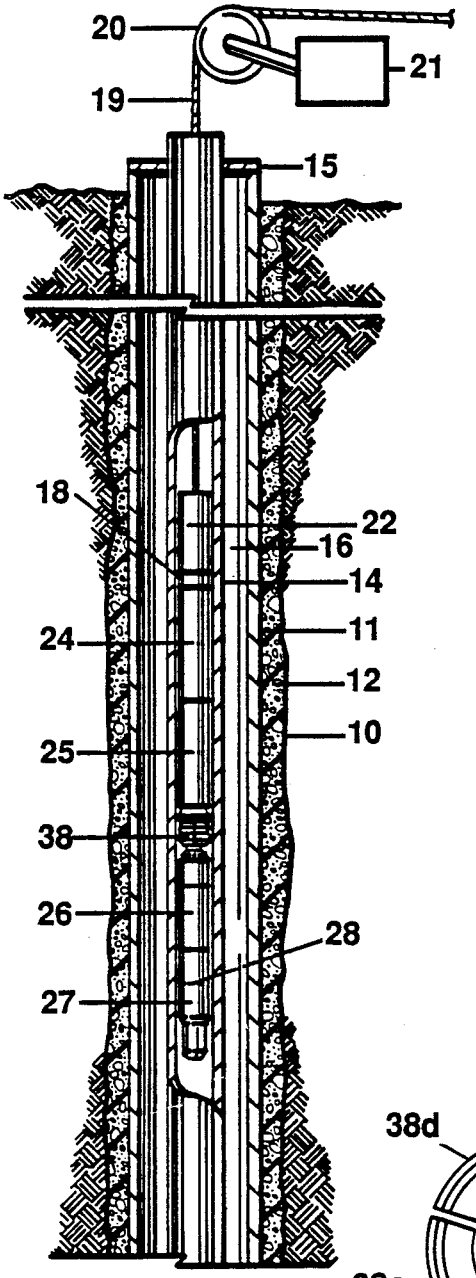
FIG. 1 is an illustration, partly in section, showing a downhole chemical cutter located in a well.

In accordance with the present invention there is provided a new chemical cutting tool having improved anchoring means that can be economically adjusted to anchor and centralize the tool in pipe of different sizes. In particular, a single anchoring means of a particular chemical cutter is provided with one or more interchangeable gripping slip arrays and optionally one or more interchangeable expansion mandrels that will enable the single anchoring means to function satisfactorily in pipes of different diameters resulting in considerable cost savings.

The use of interchangeable slip arrays and expansion mandrels afford smaller inventories and less equipment required at the job site, resulting in considerable cost saving. In a further aspect of this invention, the diameters of the serrated teeth of the slip array are constructed with specified set values to allow each tooth to make gripping contact to the inside surface of the wellbore pipe to anchor and thus centralize the tool. If the tool is not centralized in the pipe during the cutting operation, a complete severing of the pipe may not be achieved. A tool may fail to be centralized if each tooth of the slip array does not simultaneously make gripping contact with the wellbore pipe.

As indicated previously, the present invention provides an improved anchoring means for downhole well tools that not only anchors the tool, but also centralizes the tool during the operational cycle. Centralization of the chemical cutter in the wellbore pipe during the cutting operation is beneficial in obtaining a uniform cut and minimizing damage to the cutting ports of the tool. For example, when a portion of the cutting ports are disposed against the pipe's surface during the cutting operation, the enormous heat generated during the chemical reaction will dissolve the tool in this area, rendering this part of the tool useless for additional cuts. The section, or head assembly, containing the cutting ports, is a major cost of a chemical cutting tool. Therefore, centralization of the tool during the cutting operation will result in important cost savings. Additionally, the anchoring means can be easily and economically adjusted to operate in different diameters of pipe by changing the slip arrays. The anchoring means is comprised of a common slip assembly that will accept interchangeable slip arrays wherein each slip array is optimally constructed to anchor in a rather narrow range of inside diameters of a wellbore pipe wherein the pipe size is specified by the outside diameter of the pipe. The slip arrays are short in length causing the serrated gripping teeth of each interchangeable array to intersect the inside diameter of the wellbore pipe at an usually large angle with respect to the horizontal axis of the tool. With this high angle of engagement, the possibility that the slips will hang up or become stuck in the wellbore pipe is greatly reduced.

The "threaded-spring" design of the slip assembly in which a large coiled biasing spring is threadedly mounted externally on the slip assembly shaft and threadedly connected to the slip piston, allows the slip assembly to be constructed with fewer parts while permitting fast and easy assembly or disassembly to incorporate different slip arrays. The tension coiled spring externally mounted on the slip shaft which functions to return the slip array to the retracted position does not require an external sleeve. For example, by reference to FIGS. 2 and 3 of the aforementioned U.S. Pat. No. 4,345,646 to Terrell, it can be seen if a compression spring is employed as a biasing means, an external sleeve must be used to transform the compressive force in a direction to force the slip array into the retracted position. The arrangement employed in the invention reduces the outside diameter of the biasing spring. Therefore, a larger outside diameter spring with greater cross sectional area can be utilized as a biasing means. The biasing spring used in the present invention provides approximately twice the biasing force of the above referenced compression spring.

Another aspect of the invention greatly reduces the tendency of the slips to "hang-up" after the cutting operation. As noted above, the angle of engagement between the deployed slips and tool axis preferably is 18 degrees or larger, a more than two-fold increase over existing designs in which the angle of engagement is less than 8 degrees. This greatly decreases the possibility the extended slips will wedge between the slip expansion mandrel and the pipe being cut.

The anchoring means of this invention is activated by the application of fluid pressure and is particularly useful for downhole chemical cutting tools. In particular, this anchoring means affords chemical cutting tools with a decreased likelihood of the tool being rendered inoperative or stuck downhole due to mud, scale, or other accumulation that may be encountered in a wellbore. Additionally, the capability of the slip assembly to centralize the chemical cutter not only increases the useful life of the cutting ports in the head assembly but, also increases the possibility of obtaining a complete cut. The invention will now be described in detail.

Turning first to FIG. 1 of the drawings, there is illustrated a chemical cutting tool embodying the present invention disposed within a well extending from the surface of the earth to a suitable subterranean location, e.g. an oil and/or gas producing formation (not shown). More particularly and as is illustrated in FIG. 1, a wellbore 10 is provided with a casing string 11 which is cemented in place by means of a surrounding cement sheath 12. A production tubing string 14 is disposed in the well as illustrated and extends from the well head 15 to a suitable downhole location. The tubing string and/or the annular space 16 between the tubing and the casing may be filled with high pressure gas and/or a liquid such as oil or water. Alternatively the tubing string 14 or the annulus 16 may be "empty", i.e. substantially at atmospheric pressure.

As further illustrated in FIG. 1, there is shown a chemical cutting tool 18 which is suspended from a cable (wireline) 19. The cable 19 passes over suitable indicating means such as a measuring sheave 20 to a suitable support and pulley system (not shown). The measuring sheave produces a depth signal which is applied to an indicator 21 which gives a readout of the depth at which the tool is located. It will, of course, be recognized that the well structure illustrated is exemplary only and that the cutting tool can be employed in numerous other environments. For example instead of a completed well, the tool can be employed in severing a drill pipe in either a cased or uncased well. In this case the tubing string 14 shown would be replaced by a string of drill pipe.

The chemical cutter 18 is composed of five sections. At the upper end of the tool there is provided a fuse assembly 22 comprised of a fuze sub and an electrically activated fuse (not shown). Immediately below the fuse assembly 22 is a propellant section 24 which provides a source of high pressure gas. For example, the propellant section 24 may take the form of a chamber containing a propellant such as gun powder which burns to produce the propellant gases. Immediately below the propellant section 24 is a slip section 25 incorporating a slip array 38 as described in greater detail hereinafter. A chemical module section 26 is located below the slip section 25. This section contains a suitable chemical cutting agent such as halogen fluoride. Normally the chemical cutting agent will take the form of bromine trifluoride. Immediately below the chemical module section 26 is a head assembly 27. This section contains an "ignitor hair" such as steel wool which activates the halogen fluoride, bringing it to a temperature that will dissolve the tubing 14. The head assembly 27 also contains cutting ports 28 through which the fluid is directed against the interior wall of the tubing string 14. In this case, the head section is equipped with ports 28 extending about the periphery, thereof, to completely sever the tubing string 14 in the well.

The operation of the chemical cutting tool may be described briefly as follows. The tool is run into the well on the wire line 19 to the desired depth at which the cut is to be made. An electrical signal is then sent via wireline 19 to the chemical cutter tool 18 where it sets off the fuse, in turn igniting the propellant. As the propellant burns, a high pressure gas is generated and travels downward through the slip section 25 and forces the slip array 38 outwardly in a manner described hereinafter. The slip array 38 thus anchors the chemical cutter tool 18 in the tubing string 14. As the gas pressure further increases, seal diaphragms within the chemical module section 26 are ruptured and the halogen fluoride is forced through the ignitor hair which pre-ignites the chemical. The gas pressure then forces the activated chemical into the head section and ultimately outwardly through cutting ports 28. In a short period of time, normally less than a second, the tubing is severed, and the slip array is retracted so that the chemical cutter tool 18 can then be withdrawn from the tubing string 14. For a further description of the general operating conditions and parameters employed in the chemical cutter tool 18, reference may be made to the aforementioned U.S. Pat. Nos. 4,345,646 and 4,415,029, the entire disclosure of which are incorporated herein by reference.

Figure 3:
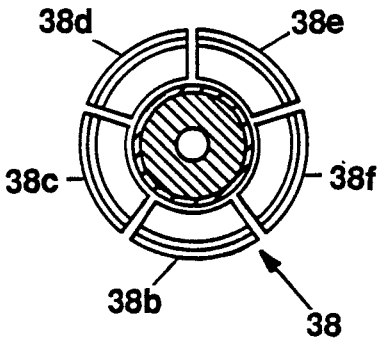
FIG. 3 is a view, partly in section, taken along line 3—3 in FIG. 2.
Figure 2:
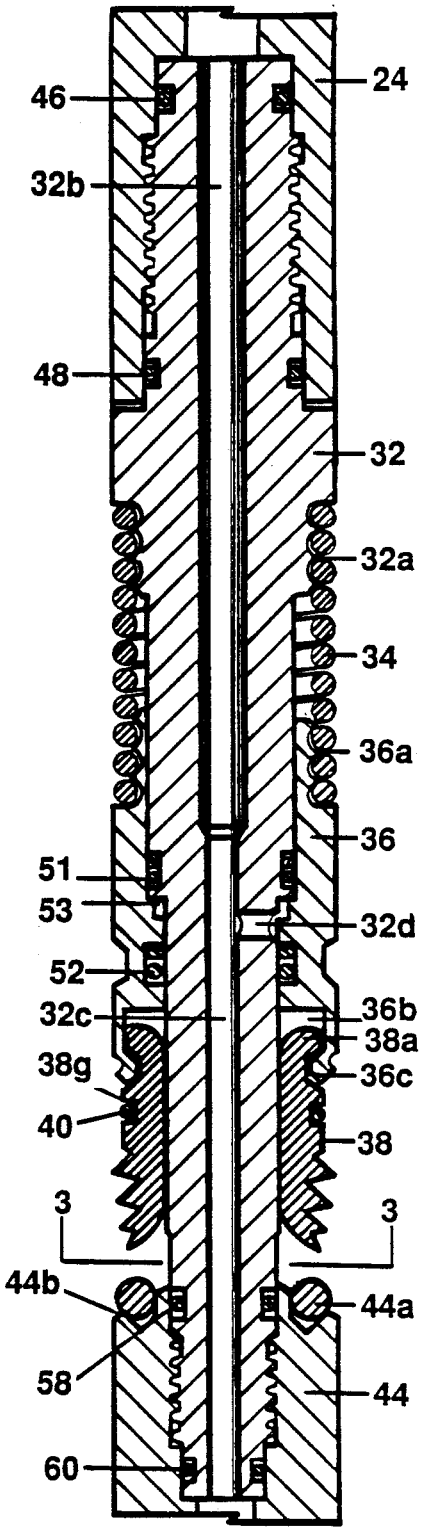
FIG. 2 is a sectional elevational view of a potion of the chemical cutter illustrating the anchoring and centralizing means and the actuating mechanism constructed in accordance with the present invention.
Figure 10:
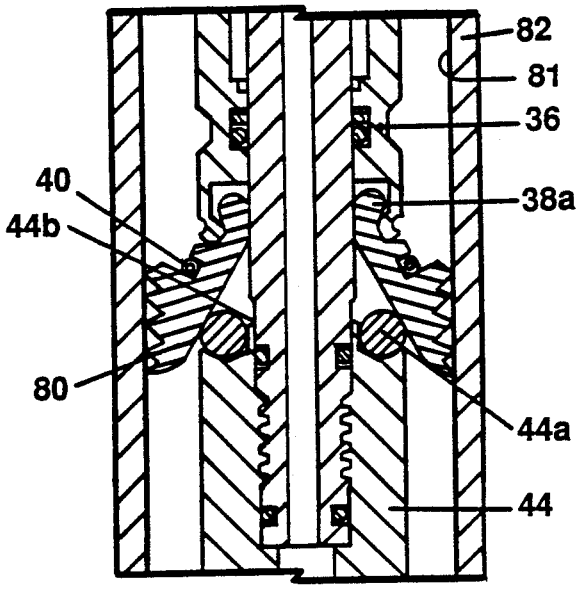
FIG. 10 is a cross-sectional, elevational view of the interchangeable slip array for and deployed against 2-$\frac{7}{8}$ inch outside diameter pipe.
Figure 11:
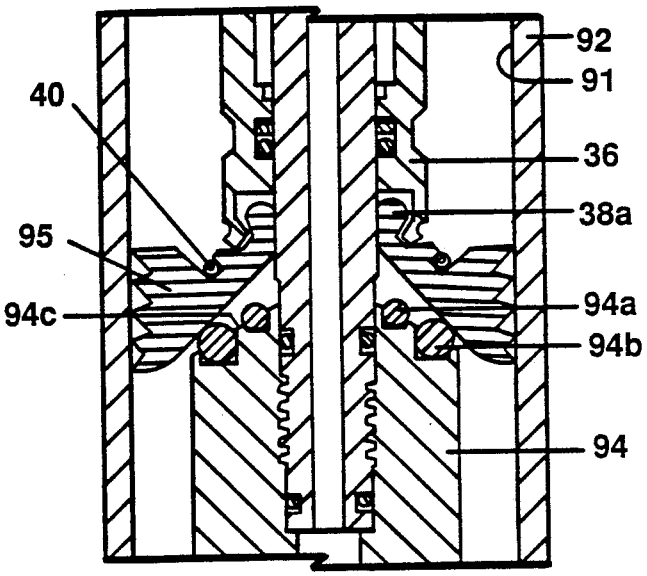
FIG. 11 is a cross-sectional, elevational view of the interchangeable slip array for and deployed against 4 inch outside diameter pipe.

Turning now to FIG. 2 there is shown an enlarged sectional view of slip section 25 of FIG. 1. The slip section 25 comprises a slip shaft 32 threaded to the propellant assembly 24. This connection is provided with a fluid seal by suitable packing means such as 0-rings 46 and 48. A slip piston 36 is slidably mounted on the slip shaft 32. The slip piston 36 is connected to the slip shaft 32 by means of a tension spring 34. The spring anchoring surface **32*a* of the slip shaft 32 and the spring anchoring surface 36*a* of slip piston 36 are threaded with a thread form matching the inside surface of tension spring 34. Tension spring 34 is threadedly connected to the slip shaft 32 at the spring anchoring surface 32*a* and connected to the slip piston 36 at the spring anchoring surface 36*a*. The threaded connection between the tension spring 34 and slip shaft 32 and slip piston 36 allows the use of a large extension tension spring 34, instead of a smaller compression spring enclosed in an external slidable sleeve as disclosed in aforementioned U.S. Pat. No. 4,345,646 to Terrell. The larger tension spring 34 supplies approximately twice the biasing force to return the slip piston 36 to its retracted position. Additionally, the threaded tension spring 34 design provides a low-cost arrangement allowing for easy and fast assembly and disassembly of the slip section 25, facilitating exchange of slip assemblies. Slip piston 36 is constructed with a partially open-ended annulus 36*b*. A lower centrally apertured flange 36*c* forms the base portion of annulus 36*b*. The upper head portions of slip segments 38*b*, 38*c*, 38*d*, 38*e*, and 38*f* of FIG. 3 are each configured in the form of an oblate torus 38*a* (FIG. 2) which allows the slip array 38 to be pivotally seated in the annulus 36*b* of slip piston 36 and mounted about slip shaft 32. Slip array 38 can be interchanged with other slip arrays for wellbore pipes of different diameters, as shown in FIG. 10 and FIG. 11** and described in detail later.

The end of the slip shaft 32, below the slip array 38 is threadedly connected to slip expansion mandrel 44. This threaded connection is afforded a fluid seal by 0-rings 58 and 60. Ball bearings **44*a* are mounted in the tapered frusto conical surface 44*b* and in cooperation with ball bearings 44*a* serve to splay slip array 38 outward in response to downward movement of the slip piston 36. Ball bearings 44*a* mounted on surface 44*b* create a convex surface on which slip segments 38*b*, 38*c*, 38*d*, 38*e*, and 38*f* of FIG. 3 ride and provide hardened inserts eliminating the need to harden the upper surface 44*b* of the expansion mandrel 44. The slip expansion mandrel 44 is threadedly connected to the chemical module section 26 (shown in FIG. 1). 0-rings (not shown) are employed to form a fluid seal for this connection. The expansion mandrel 44** can be interchanged with a larger outside diameter expansion mandrel as will be detailed later.

Figure 4:
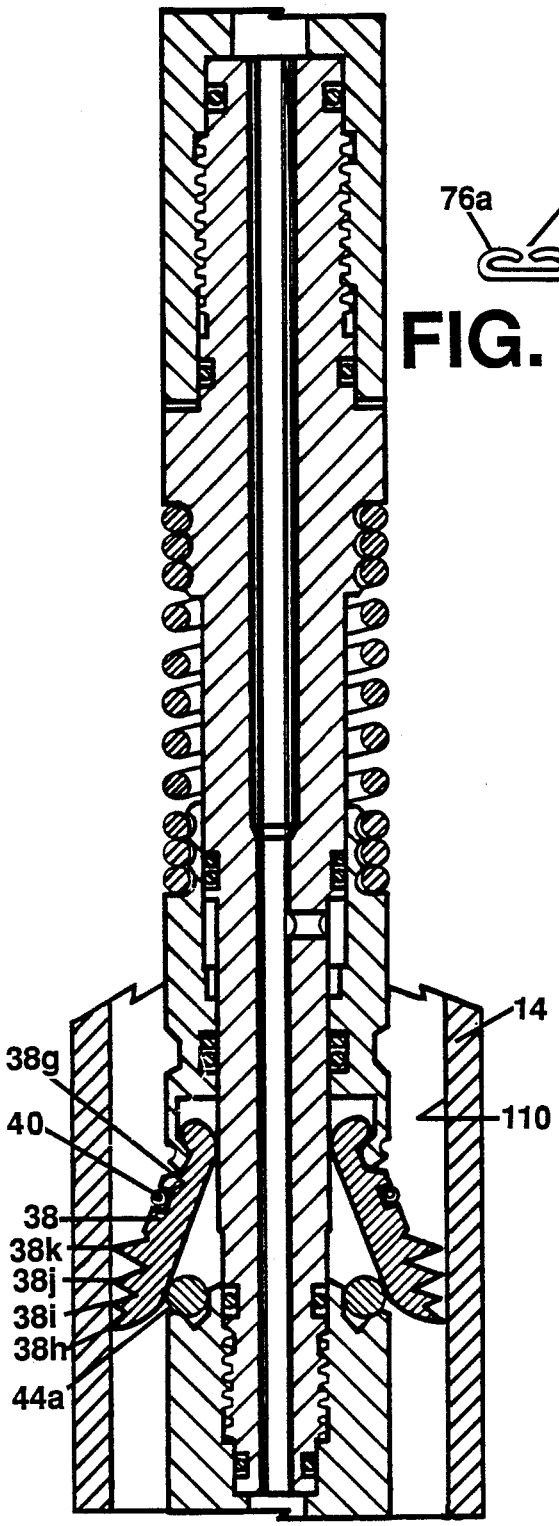
FIG. 4 is a sectional elevational view of the anchoring and centralizing means of FIG. 2 shown deployed against the wellbore pipe.

The slip shaft 32 is provided with a longitudinal passage **32*b* and 32*c* which provides for fluid communication between the propellant section 24 and chemical section 26. The slip shaft 32 is also provided with one or more exhaust ports 32*d* which extend transversely from passage 32*c* to the exterior surface of slip shaft 32 and thence into the active surface of active cavity 53 which serves as an expansion chamber of slip piston 36. 0-rings 51 and 52 provide a fluid seal about active cavity 53. Referring to FIG. 2 fluid pressure entering passageway 32*c* will be applied to the active cavity 53 causing the slip piston 36 to move downward forcing the slip segments 38 outwardly as they ride up on the ball bearings 44*a* of the tapered surface 44*b*. This deployed position can also be seen from an examination of FIG. 4 which is an illustration of the slip assembly of the present invention, corresponding generally to FIG. 2, but showing a side elevation of the slip array 38** in the deployed position.

Figure 5A:
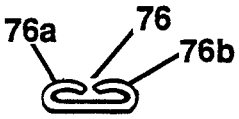
FIG. 5*a* is an illustration of the connecting wire for the slip array spring.
Figure 5:
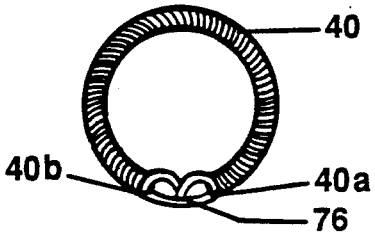
FIG. 5 is an illustration of the slip array biasing spring with end loops connected by a short length of soft metal wire formed with end hooks.
Figure 6:
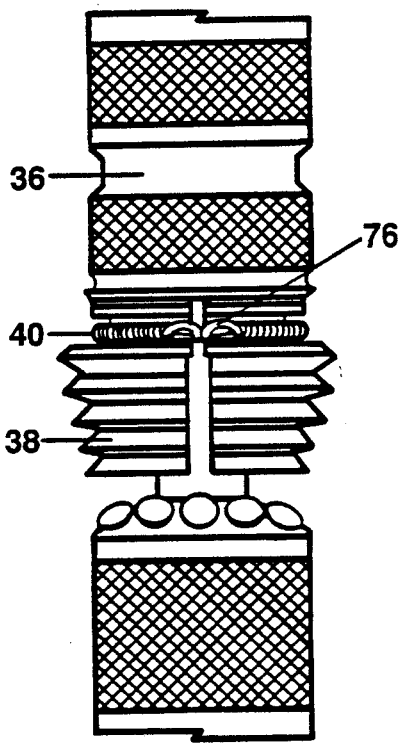
FIG. 6 is side elevational view of one of the interchangeable slip arrays illustrating the mounting location of the biasing means of FIG. 5.
Figure 7:
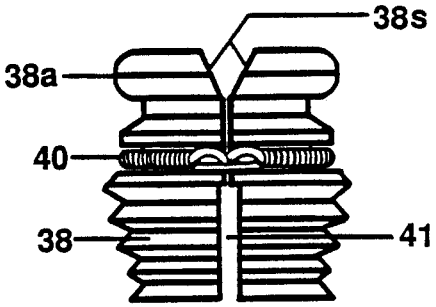
FIG. 7 is a side elevational view of the interchangeable slip array removed from FIG. 6 and held together by the biasing means of FIG. 5 illustrating the truncated surface of the oblate torus of the slip segments.

It will be noted that the slip segments are biased inwardly against the slip shaft 32 and slip expansion mandrel 44 by means of tension looped spring 40 placed in the spring groove **38*g* of slip segments 38*b*–*f*. The looped spring 40 is similar to the biasing spring used in aforementioned U.S. Pat. No. 4,345,646 but with an important innovation shown in FIGS. 5 and 5*a*. Referring to FIG. 5, the looped ends 40*a* and 40*b* of looped spring 40 are connected together by a soft steel wire double loop configuration or connector wire 76. An enlarged view of wire 76 is shown in FIG. 5*a*. The looped ends 40*a* and 40*b* of the looped spring 40 are placed in the partially open loops of connector wire 76. The looped ends 76*a* and 76*b* of the connector wire are manually closed with an ordinary hand tool such as pliers. The resulting tension spring 40 confined into a loop by this technique does not exhibit the tendency to break downhole during the cutting operation. The connection of the garter spring loops 40*a* and 40*b* by connector wire 76 provides an epicyclic restraining force that appears to alleviate mechanical stresses that would occur if loops 40*a* and 40*b* were joined directly together, one loop interconnecting the other. Additionally, the connector wire 76 offers a pivotal connection in which expansion forces are applied to the center of the spring as the slip segments are expanded into the deployed position to anchor the chemical cutter during the cutting operation. FIG. 6 is a side elevational view of slip array 38 in the retracted position with garter spring 40 installed. FIG. 7 is a side elevational view of slip array 38 removed from slip piston 36 FIG. 6 and held together by garter spring 40. A truncated surface 38*s* is ground on each side of the oblate torus 38*a* of each slip segment 38*b*, 38*c*, 38*d*, 38*e*, and 38*f*. This truncated surface 38*s* allows the slip segments to expand to the deployed position when they are mounted in slip piston 36. The increased open area or slots 41 between the slip segments below spring 40** allow for some debris between adjacent slip segments.

Since each slip array is designed to work in only in a very narrow range of inside pipe diameter, the tip of the teeth lie generally along a straight line. Thus, it is unnecessary to use slips provided with gripping teeth in a plurality of discrete annulation patterns as disclosed for example in the aforementioned U.S. Pat. No. 4,345,646. This configuration, together with the relatively high angle of deployment which enhances the radially outward force exerted against the inside pipe surface, enables the use of relatively short slip segments. More particularly, the slip segments preferably exhibit a length to width ratio of about 2 or less. This may be contrasted with length to width ratios on the order of 4–5 normally encountered in prior art tools.

Figure 8A:
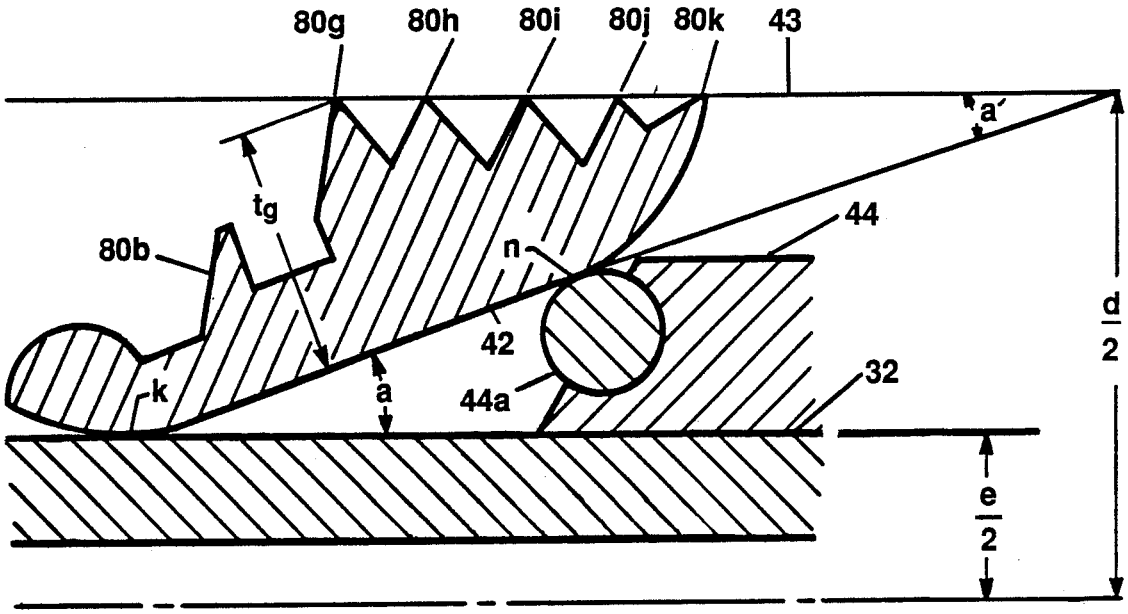
FIG. 8*a* is a cross-sectional view of a slip segment shown deployed against the inside surface of a wellbore pipe depicting technique to calculate the sets of gripping teeth diameters.
Figure 8B:
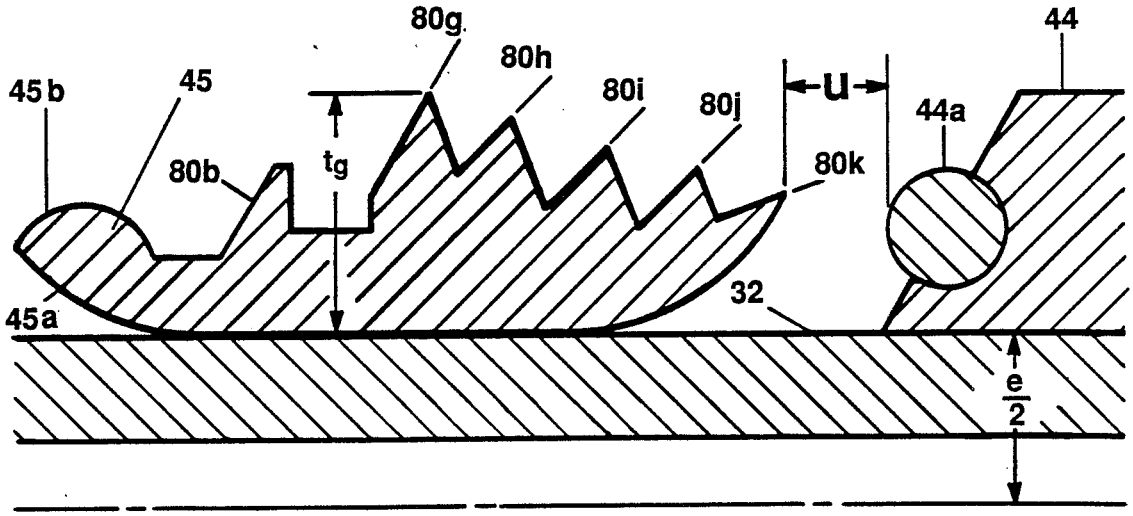
FIG. 8*b* is a cross-sectional view of a slip segment shown retracted against the slip shaft depicting technique to calculate the sets of gripping teeth diameters.

FIGS. 8*a* and 8*b* illustrate a technique for determination of the outside diameters of a set of gripping teeth 80*g*, 80*h*, 80*i*, 80*j*, and 80*k* of one slip segment of slip array 80, shown also in FIG. 10. Slip array 80 is designed to anchor and centralize in pipe with a 2 $\frac{7}{8}$ inch outside diameter having an inside diameter of about 2 $\frac{5}{8}$. One slip segment 80*b* of slip array 80 is shown in deployed position against the inside diameter of the pipe wherein the angle of engagement a is selected at 20 degrees. The angle of engagement a, also referred to herein as the deployment angle, is also defined by the congruent angle a″ formed by the intersection of an extension of the underside 42 of the slip segment 80*b* and an extension of the line 43 extending across the tips of teeth 80*g*–80*k*. The outside diameter of slip array 80 is selected to be 2.125 inches which determines the location and diameter of tooth point 80*g*. Referring now to FIG. 8*b*, the value of tg is determined by subtracting the outside diameter e of slip shaft 32 from the diameter m of the outside slip array 80 and dividing by 2:

$$tg = \frac{m - e}{2} = \frac{2.125 - .875}{2}$$

$$tg = .625 \text{ inches}$$

Again referring to FIG. 8*a*, the design dimensional location of ball bearing 44*a* determines the location of point of contact n between the slip segment 80*b* and ball bearing 44*a* surface and the point of contact k between the slip segment 80*b* and the slip shaft 32. Then by employing straight forward trigonometry, the height of tooth 80*k* can be determined and thusly the diameter of the tooth point 80*k* in slip array 80. The diameter of the tooth points in the retracted position in this slip array 80 are listed as follows:

80*g*=2.125 inches
80*h*=1.995 inches
80*i*=1.863 inches
80*j*=1.731 inches
80*k*=1.601 inches Therefore, it can be easily seen how each internal pipe diameter serves to specify the design of each slip array if centralization of the tool is to be adequately accomplished when the slip segments are deployed in the cutting position.

The oblate torus configuration of the slip segment heads is illustrated in detail in FIGS. 8*a* and 8*b*. The head 45 has a lower relatively flattened segment 45*a*. The radius of curvature of segment 45*a* is relatively large in comparison with the radius of curvature of the upper segment 45*b* of head 45. Typically, the radius of curvature of the lower segment 45*a* is at least triple the radius of curvature 45*b*. In an embodiment of the invention useful in cutting pipes ranging to about 4″ in diameter, the radius of curvature of upper segment 45*b* is 5/32″ and the radius of curvature of lower segment 45*a* is $\frac{5}{8}$″, quadruple the radius of curvature of the upper segment.

To assure that the slip segments have adequate distance to close after being deployed a "standoff" distance "u" is provided between the slip array 80 and ball bearing 44*a* when the slip array 80 is in the retracted position.

Figure 9:
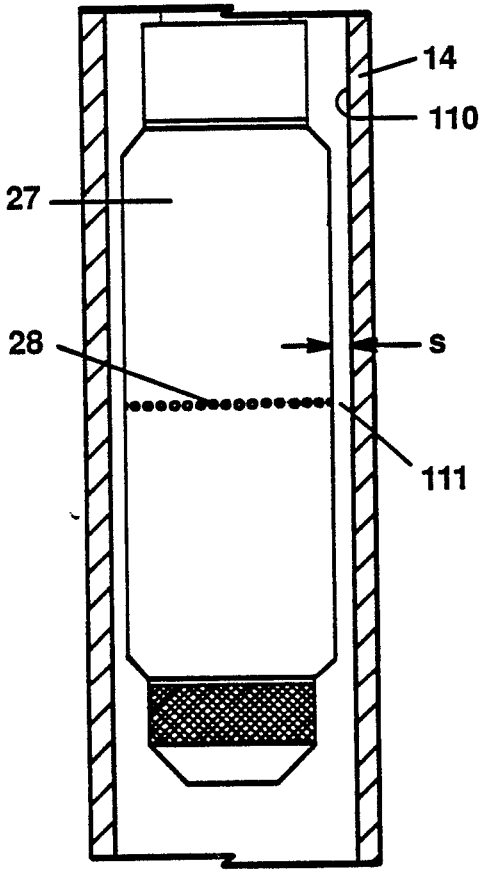
FIG. 9 is a partial elevational view of the cutting ports section of the chemical cutter illustrating the importance of centralizing the tool during the cutting operation.

The importance of centralizing the chemical cutter during the cutting operation can be illustrated by referring to FIG. 9. Activated chemical is forced through the head section 27 and then through the ports 28, impinging on the internal surface 110 of the wellbore pipe 14, producing a tremendous exothermic reaction between halogen fluoride and the metal cutting surface. White hot temperatures in excess of 2,000°F. are generated immediately in the space between the cutting ports and the inside diameter of the pipe adjacent the head assembly 27. Copper is a relatively inexpensive metal that will conduct the heat away from the ports 28 fast enough to avoid vast damage to the tool. The value of the temperature from the area 111 of this chemical reaction varies approximately inversely the square of the distance from this reaction point. If the head assembly 27 is in a decentralized position against the pipe string 14 during the cutting operation the area closest to the pipe will be subjected to extreme temperatures causing non-repairable damage to the ports 28 by actually burning large holes in the head assembly 27, rendering the assembly unusable. From experience, it has been found that if the distance s is greater than about 0.125 inch, damage to the head assembly does not occur during the cutting cycle. Therefore, a tool that is improperly centralized can experience damage to the head assembly, by having large holes burned in the port area. The head assembly is an expensive component and is normally reusable from five to twenty times, if it is not damaged. Additionally, experience has shown that good centralization of the head assembly will nearly always make a complete cut. That is, if the distance s in FIG. 9 is zero or close to zero whereby the head assembly 27 is laying against the surface 110, the head assembly 27 will be damaged and in all likelihood the pipe 14 will not be completely severed on the opposite side of head assembly 27. Therefore, the importance of a slip assembly that will centralize the chemical cutter during the cutting operation can be readily seen.

Now turning to FIG. 10 there is shown a cross-sectional view of slip array 80 in the deployed position. Slip array 80 is designed to anchor and centralize the chemical cutter in 2-$\frac{7}{8}$ inch outside diameter pipe. Slip array 80 is interchangeable with slip array 38 FIG. 2 and is also installed in slip piston 36 employing slip shaft 32 and expansion mandrel 44. Downward movement of slip piston 36 will force slip array 80 against the tapered frusto conical surface 44*b* and in cooperation with ball bearings 44*a* serve to splay the slips segments 80 against the inside surface 81 of a wellbore pipe 82, anchoring and centralizing the chemical cutter during the cutting operation. It will be recognized that slip array 80 is constructed with the same oblate torus configuration 38*a* and utilizes the same garter spring 40 as slip array 38 in FIG. 2.

A further embodiment of this invention is shown in FIG. 11 which is a cross-sectional view of a slip array 95 in the deployed position. The slip array 95 is designed to anchor and centralize the chemical cutter 18 (FIG. 1) in 4 inch outside diameter pipe. Slip array 95 is interchangeable with slip array 38 and is also installed in slip piston 36 employing slip shaft 32 but employing a different slip expansion mandrel 94. Expansion mandrel 94 is constructed with two rows of concentric ball bearings 94*a* and 94*b* mounted in the tapered frusto conical surface 94*c* and in cooperation with ball bearings 94*a* and 94*b* serves to splay slip segments 95 against inside surface 91 of wellbore pipe 92 anchoring and centralizing the chemical cutter during the cutting operation. Ball bearings 94*a* and 94*b* are mounted on surface 94*c* to create a surface on which slip segments 95 ride. Ball bearings 94*a* and 94*b* eliminate the need to harden the upper surface of the expansion mandrel 94. As the slip segments 95 are forced against the expansion mandrel 94 the initial expansion of the slip segments 95 are accomplished by contacting first concentric row of ball bearing 94*a* and then the final expansion of slip segments 95 against inside surface 91 of wellbore pipe 92 is accomplished by the second concentric row of ball bearings 94*b*. It will be noted by viewing FIG. 11 that slip array 95 is constructed with the same size oblate torus configuration 38*a* and utilizes the same garter spring 40 as slip array 38.

The high deployment angles made possible by the present invention may be contrasted with those in the prior art, as depicted, for example, by reference to the slip assembly disclosed in U.S. Pat. No. 4,345,646. As can be seen by reference to FIGS. 3 and 12 of Pat. No. 4,345,648, the deployment angle between the bottom surfaces of the slip segments and the horizontal axis of the slip shaft would be less than 8 degrees when the slip segments are in the deployed position. This small angle of engagement can cause the slip segments to occasionally wedge between the slip expansion mandrel and the pipe being cut causing the tool to become stuck downhole. Another problem with this design is in the garter spring that functions to inwardly bias the slip segments. The spring may break during the cutting operation, resulting in a portion of the broken spring being wedged between the tool and wellbore causing the tool to stick downhole.

As is evident from the foregoing description, each of the interchangeable slip arrays incorporate slip segments having serrated gripping teeth configured in relationships to accommodate different pipe sizes. For each of the slip segments, the serrated gripping teeth are configured in a relationship in which the teeth simultaneously touches a locus defined by a diametrically specified cylindrical surface which is coaxial with the slip array. For an intermediate size 2-$\frac{7}{8}$" pipe, as described above with reference to FIGS. 8 and 10, the locus is defined by a cylindrical surface having diameter of 2-$\frac{1}{2}$". The deployment angle for this slip array is about 20° as described previously. For a larger pipe size having an outside diameter of about 4", for example as depicted by FIG. 11, the locus of engagement of the serrated gripping teeth is a cylindrical surface having a diameter of about 3-$\frac{1}{2}$". Here, the deployment angle is about 46°, and as described above, the expansion mandrel will be exchanged with a larger expansion mandrel as described above. For a smaller size pipe having a nominal diameter of about 2-$\frac{3}{8}$", the locus of engagement by the serrated gripping teeth will be defined by a cylindrical surface coaxial with the slip shaft and having a diameter of 2". Here, the deployment angle usually is slightly less than that described above, i.e. about 18°, although the deployment angle can be substantially the same as the deployment angle used for the intermediate slip array. The smaller cylindrical locus is accommodated partially or entirely (for a deployment angle of 20°) by slightly smaller measurements corresponding to $T_g$ and $T_k$ disclosed in FIG. 8*a*. In every case, the deployment angle is sufficiently great to provide a radially outward force component which is adequate to firmly anchor and center the cutting tool during the cutting operation.

Having described specific embodiments of the present invention, it will be understood that modification thereof may be suggested to those skilled in the art, and it is intended to cover all such modifications as fall within the scope of the appended claims.

We claim:

1. In a downhole chemical cutting tool having a chemical section adapted to contain a chemical cutting agent and a cutting section in fluid communication with said chemical section and having cutting ports for the discharge of chemical cutting agent, said tool adapted to be inserted into a wellbore and anchored at a downhole location, thereof, the combination comprising:

(a) an elongated slip shaft extending longitudinally of said tool;

(b) slip actuation means mounted on said slip shaft;

(c) biasing means for biasing said slip actuation means toward a retracted position;

(d) a slip array comprising a plurality of slip segments having serrated outside gripping teeth circumferentially mounted on said slip shaft and pivotally connected at their head ends to said slip actuation means, said slip segments being configured to provide a deployment angle of about 18 degrees or more between the horizontal axis of said slip shaft and the internal surfaces of said slip segments in the hereinafter recited deployed position;

(e) slip expansion mandrel means secured to said shaft at a location between said cutting ports and said slip array and having a tapered surface adapted to receive said slip segments to expand said array into a deployed position upon the movement of said array in the direction of said mandrel means, and (f) inward biasing means for said slip array to force said slip segments inwardly around said slip shaft.

2. The combination of claim 1 wherein said tapered surface of said expansion mandrel intersects the horizontal axis of said slip shaft at an angle of approximately 50 degrees or larger.

3. The combination of claim 1 further comprising a second slip array adapted to replace the slip array of subparagraph (d) of claim 1, said second slip array comprising a plurality of slip segments having serrated outside gripping teeth and adapted to be circumferentially mounted on said slip shaft and pivotally connected to said slip actuation means, the slip segments of said second slip array being configured to provide a deployment angle between the horizontal axis of said slip shaft and the internal surfaces of said second array slip segments in the deployed position greater than the deployment angle of said first recited slip array.

4. The combination of claim 3 further comprising a third slip array adapted to replace the slip array of subparagraph (d) of claim 1, said second slip array comprising a plurality of slip segments having serrated outside gripping teeth and adapted to be circumferentially mounted on said slip shaft and pivotally connected to said slip actuation means, the slip segments of said third slip array being configured to provide a deployment angle between the horizontal axis of said slip shaft and the internal surfaces of said third array slip segments in the deployed position greater than the deployment angle of said second slip array.

5. In a downhole chemical cutting tool having a chemical section adapted to contain a chemical cutting agent and a cutting section in fluid communication with said chemical section and having cutting ports for the discharge of chemical cutting agent, said tool adapted to be inserted into a wellbore and anchored at a downhole location, thereof, the combination comprising:

(a) an elongated slip shaft extending longitudinally of said tool;

(b) slip actuation means mounted on said slip shaft;

(c) biasing means for biasing of said slip actuation means toward a retracted position;

(d) a plurality of interchangeable slip arrays each comprising a plurality of slip segments having serrated outside gripping teeth and adapted to be circumferentially mounted on said slip shaft and pivotally connected at their head ends to said slip actuation means, a first of said slip arrays comprising slip segments configured to provide a first deployment angle as measured between the intersection of an extension of the underside internal surface of said slip segments with the extension of the tips of the outside serrated gripping teeth of said slip segments, and a second of said slip arrays comprising slip segments configured to provide a second deployment angle greater than said deployment angle of said first slip array;

(e) slip expansion mandrel means secured to said shaft at a location between said cutting ports and said slip array and having a tapered surface adapted to receive the slip segments of a slip array to expand said array into a deployed position upon the movement of said array in the direction of said mandrel means; and (f) inward biasing means for said slip array to force said slip segments inwardly around said slip shaft.

6. The combination of claim 5 wherein said first deployment angle is at least about 18°.

7. The combination of claim 6 wherein said second deployment angle is no greater than 50°.

8. The combination of claim 5 wherein the slip segments of said slip arrays each have a spring receiving groove between said serrated outside gripping teeth and the head ends of said slip segments and wherein said inward biasing means comprises a tension spring adapted to fit around the slip segments of a slip array and received within said receiving grooves of said slip segments.

9. In a downhole chemical cutting tool having a chemical section adapted to contain a chemical cutting agent and a cutting section in fluid communication with said chemical section and having cutting ports for the discharge of chemical cutting agent, said tool adapted to be inserted into a wellbore and anchored at a downhole location, thereof, the combination comprising:

(a) an elongated slip shaft extending longitudinally of said tool;

(b) slip actuation means mounted on said slip shaft;

(c) biasing means for biasing of said slip actuation means toward a retracted position;

(d) a plurality of interchangeable slip arrays each comprising a plurality of slip segments having serrated outside gripping teeth and adapted to be circumferentially mounted on said slip shaft and pivotally connected at their head ends to said slip actuation means, a first of said slip arrays comprising slip segments configured in a relationship wherein the serrated gripping teeth of said slip segments when said first slip array is in the deployed position simultaneously touch a first locus defined by a first diametrically specified cylindrical surface coaxial with said slip shaft and surrounding the slip array, and a second of said slip arrays comprising slip segments configured in a relationship wherein the serrated gripping teeth of said slip segments, when said second slip array is in the deployed position, simultaneously touch a second locus defined by a second diametrically specified cylindrical surface of a diameter greater than said first cylindrical surface and being coaxial with said slip shaft and surrounding the slip array;

(e) slip expansion mandrel means secured to said shaft at a location between said cutting ports and said slip array and having a tapered surface adapted to receive the slip segments of a slip array to expand said array into a deployed position upon the movement of said array in the direction of said mandrel means; and (f) inward biasing means for said slip array to force said slip segments inwardly around said slip shaft.

10. The combination of claim 9 further comprising a third step array comprising a plurality of slip segments having serrated outside gripping teeth and adapted to be circumferentially mounted on said slip shaft and pivotally connected to said slip actuation means, the segments of said third slip array being configured in a relationship wherein the serrated gripping teeth of said slip segments, when said third slip array is in the deployed position, simultaneously touch a third locus defined by a third diametrically specified cylindrical surface of a diameter greater than said second cylindrical surface and being coaxial with said slip shaft and surrounding the slip array.

11. In a downhole chemical cutting tool having a chemical section adapted to contain a chemical cutting agent and a cutting section in fluid communication with said chemical section and having cutting ports for the discharge of chemical cutting agent, said tool adapted to be inserted into a wellbore and anchored at a downhole location, thereof, the combination comprising:

(a) an elongated slip shaft extending longitudinally of said tool;

(b) slip actuation means mounted on said slip shaft;

(c) biasing means for biasing said slip actuation means toward a retracted position;

(d) a slip array comprising a plurality of slip segments circumferentially mounted on said slip shaft having serrated outside gripping teeth and pivotally connected at their head ends to said slip actuation means, the tips of the outside gripping teeth of said slip segments lying in a straight line, said slip segments being configured so that the ratio of the length of said slip segments to the width of said slip segments is about two or less;

(e) slip expansion mandrel means secured to said shaft at a location between said cutting ports and said slip array and having a tapered surface adapted to receive said slip segments to expand said array into a deployed position upon the movement of said array in the direction of said mandrel means; and (f) inward biasing means for said slip array to force said slip segments inwardly around said slip shaft.

12. The combination of claim 11, wherein, said biasing means for said slip actuating means comprises a tension spring threadedly connected to and between said slip actuating means and said slip shaft.

13. The combination of claim 11, wherein said slip segments each have a spring receiving groove between said serrated outside gripping teeth and the head ends of said slip segments and wherein said inward biasing means comprises a tension spring fitting around the slip segments and received within said receiving grooves of said slip segments.

14. In a downhole chemical cutting tool having a chemical section adapted to contain a chemical cutting agent and a cutting section in fluid communication with said chemical module section and having cutting ports for the discharge of chemical cutting agent, said tool adapted to be inserted into a wellbore and anchored at downhole location, thereof, the combination comprising:

(a) an elongated slip shaft extending longitudinally of said tool and having a fluid passage extending longitudinally therethrough and at least one exhaust port extending transversely of said slip shaft from said passage to the exterior surface of said slip shaft;

(b) a slip array comprising a plurality of slip segments circumferentially mounted on said slip shaft having serrated outside gripping teeth with outside diameters constructed in sets of controllable specified diameters the top portions of said slip segments constructed of an oblate torus and slidably disposed around the peripheral surface of said slip shaft;

(c) a slip piston sleeve slidably mounted on said slip shaft and connected to said slip array, said slip piston sleeve defining a piston chamber in fluid communication with said exhaust port of said slip shaft having an active surface interposed between said exhaust port and slip expansion mandrel means whereby the application of fluid pressure to said active surface forces said slip array in the direction of said expansion mandrel means, said slip piston having a partially open cylindrical cavity to pivotally and connectively receive said segmented oblate torus of said slip segments;

(d) biasing means connected to and between said slip shaft and said slip piston;

(e) inward biasing means associated with said slip array to force said slip segments against said slip shaft said biasing means comprised of a tension spring joined at the ends; and (f) slip expansion mandrel means secured to said slip shaft adjacent to said slip array having localized hardened surface areas on upper surface of said expansion mandrel means adapted to expand said slip segments in the deployed position.

15. The combination of claim 14, wherein, said slip piston biasing means comprises a tension spring threadedly connected to and between said slip piston and said slip shaft.

16. The combination of claim 15, wherein, the outside diameter of said tension spring is less than the outside diameter of said slip shaft.

17. The combination of claim 14, whereby, the serrated gripping teeth of said slip segments are configured in a relationship wherein a portion of each said tooth points simultaneously touches a locus defined by diametrically specified cylindrical surface coaxial with said slip shaft and surrounding the slip array when said slip array is in the deployed position.

18. The combination of claim 14, whereby, a circumferential groove is provided in each said slip segment between the said oblate torus and said external gripping teeth to receive said slip segment biasing tension spring.

19. The combination of claim 18, wherein, the end loops of said tension spring are joined by an articulated connection providing an epicyclic restraining force to said tension spring.

20. The combination of claim 19, wherein, the said articulated connection comprises a length of soft metal wire the ends of which are formed into hooks that are bent to capture and join end loops of said spring.

21. The combination of claim 18, further comprising a second slip array interchangeable with said first slip array, and wherein the torus and said slip segment biasing spring groove of the segments of each of said slip arrays is constructed of approximately identical mechanical dimensions.

22. The combination of claim 21, wherein, the first and second of said slip arrays are constructed with different controllable specified sets of outside diameters of gripping teeth.

23. The combination of claim 14, wherein, the said tapered surface of said expansion mandrel is constructed with one or more concentric rows of convex insets providing bearing surfaces for said slip segments to be forced in the deployed position by the activation of said slip piston.

* * * * *